US007188788B2

(12) United States Patent
Augustin

(10) Patent No.: US 7,188,788 B2
(45) Date of Patent: Mar. 13, 2007

(54) COMMON RAIL INJECTOR WITH ACTIVE NEEDLE CLOSING DEVICE

(75) Inventor: Ulrich Augustin, Blythewood, SC (US)

(73) Assignee: Siemens VDO Automotive Corporation, Auburn Hills ( * ) Notice: Subject to any disclaimer, the term of this patent is extended or adjusted under 35 U.S.C. 154(b) by 0 days.

(21) Appl. No.: 11/358,345

(22) Filed: Feb. 21, 2006

(65) Prior Publication Data

US 2006/0186227 A1 Aug. 24, 2006

Related U.S. Application Data

(60) Provisional application No. 60/655,301, filed on Feb. 22, 2005.

(51) Int. Cl.
*F02M 61/10* (2006.01)

(52) U.S. Cl. ..... 239/533.11; 239/533.2; 239/533.3; 239/533.4; 239/102.2; 239/585.1; 123/467; 257/129.06

(58) Field of Classification Search ..... 239/533.11, 239/533.2, 533.3, 533.4, 585.1, 102.2; 123/467, 123/496, 498; 310/326, 327; 251/129.06
See application file for complete search history.

(56) References Cited

U.S. PATENT DOCUMENTS

| | | | | |
|---|---|---|---|---|
| 4,382,554 | A * | 5/1983 | Hofmann | 239/533.9 |
| 4,658,824 | A * | 4/1987 | Scheibe | 123/472 |
| 5,020,500 | A | 6/1991 | Kelly | |
| 5,899,389 | A * | 5/1999 | Pataki et al. | 239/533.2 |
| 6,279,840 | B1 * | 8/2001 | Buckley | 239/533.4 |
| 6,896,208 | B2 * | 5/2005 | Kuegler | 239/533.4 |

* cited by examiner

*Primary Examiner*—Dinh Q. Nguyen

(57) ABSTRACT

A fuel injector includes a needle valve having a metering land that corresponds with the metering edge to define a metering gap. The metering gap produces a pressure drop utilized to tailor needle valve opening and closing response times.

5 Claims, 6 Drawing Sheets

COMMON RAIL INJECTOR WITH ACTIVE NEEDLE CLOSING DEVICE

CROSS REFERENCE TO RELATED APPLICATION

The application claims priority to U.S. Provisional Application No. 60/655,301 filed Feb. 22, 2005.

BACKGROUND OF THE INVENTION

This invention generally relates to a fuel injector for an internal combustion engine. More particularly, this invention relates to a fuel injector with an active closing needle valve.

A fuel injection system includes a fuel rail that communicates fuel to a plurality of fuel injectors. In some applications the fuel injector does not include a control piston and therefore does not have a steady leakage that is advantageous for diesel engine applications. Without a separate control piston, the fuel injector does not close as quickly as desired. A needle valve within the fuel injector closes by way of a biasing spring that closes once fuel pressure drops below a determined pressure. Common fuel injectors include a throttle valve that supports the closing process. The use of a throttle valve reduces injection pressure. However, it is desirable to increase fuel injection pressures to increase performance and fuel efficiency.

Accordingly, it is desirable to develop and design a fuel injector that provides the desired opening and closing time without reducing injection pressure.

SUMMARY OF THE INVENTION

An example fuel injector according to this invention includes a needle valve having a metering land that cooperates with a metering edge within the bore to tailor opening and closing of the needle valve.

The fuel injector includes a body portion that defines a bore that supplies fuel to an outlet. The outlet is defined by a seat having a plurality of openings through which fuel is injected. Fuel flow through the outlet is controlled by a needle valve. The needle valve includes a portion that seals on the seat defined by the outlet. The needle valve is biased towards a closed position by a biasing member such as a coil spring. Upon actuation of the fuel injector a piezo-electric valve creates a pressure differential across the needle valves such that the needle valve opens. A metering land cooperates with a metering bore to define a flow path and a desired pressure drop that provides a counter-force to further tailor the opening time of the needle valve.

Further, the metering land and metering bore provide for a reduced closing time of the needle valve. The flow path defined by the metering land and the metering bore generate a pressure differential across the metering land that generates a hydraulic bias toward closing the needle valve. The bias provides for the reduction of needle valve closing time.

Accordingly, the fuel injector according to this invention includes a needle valve having a metering land that cooperates with the metering edge defined within the bore of the fuel injector to control opening and closing of the needle valve as desired.

These and other features of the present invention can be best understood from the following specification and drawings, the following of which is a brief description.

DETAILED DESCRIPTION OF THE PREFERRED EMBODIMENT

Figure 1:
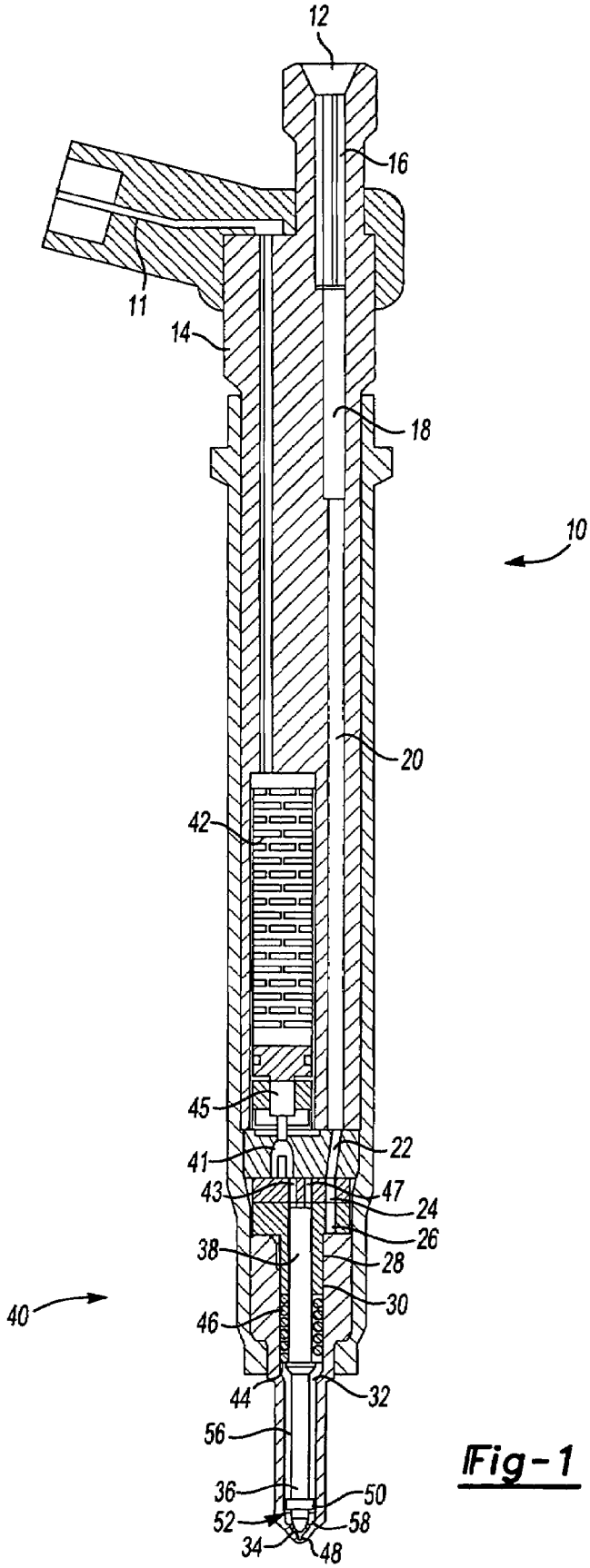
FIG. 1 is a cross-sectional view of an example fuel injector according to this invention.

Referring to FIG. 1, a fuel injection assembly 10 includes an electrical connection 11 for communicating with a vehicle controller (not shown). The fuel injector assembly 10 includes a body 14 that defines an inlet 12 and outlet 48. The inlet 12 communicates fuel through passages 18, 20, 22, 24 and 26 to a valve 40 and a metering bore 56.

The valve 40 includes a piezo-electric actuator 42 for controlling fuel flow to a needle valve 36. The valve 40 includes passages 41, 43, 45, and 47 that selectively communicate fuel to the needle valve 36 responsive to actuation of the piezo electric actuator 42.

Actuation of the piezo-electric actuator 42 selectively communicates fuel through select ones of the passages 41, 43, 45, 47 to generate a pressure differential across the needle valve 36. The generated pressure differential across the needle valve 36 causes a desired opening or closing of the needle valve 36. The needle valve 36 is biased towards a closed position by a spring 46. The spring 46 is supported between a spring perch 44 on a first end and a housing insert 49 on a second end. The needle valve 36 includes a control piston portion 38. The needle valve 36 cooperates with an outlet seat 34 to close off one of the plurality outlet openings 48.

The piezo-electric actuator 42 opens select ones of the passages 41, 43, 45, 47 to generate a pressure differential across the needle valve 36. The pressure differential across the needle valve 36 causes a decrease in pressure on an upper part of the control piston 38. This decrease in pressure generates a pressure imbalance against the spring 46 to open the needle valve 36. Opening and closing is also governed by a flow path defined between a metering land 50 and a metering edge 52.

Figure 2:
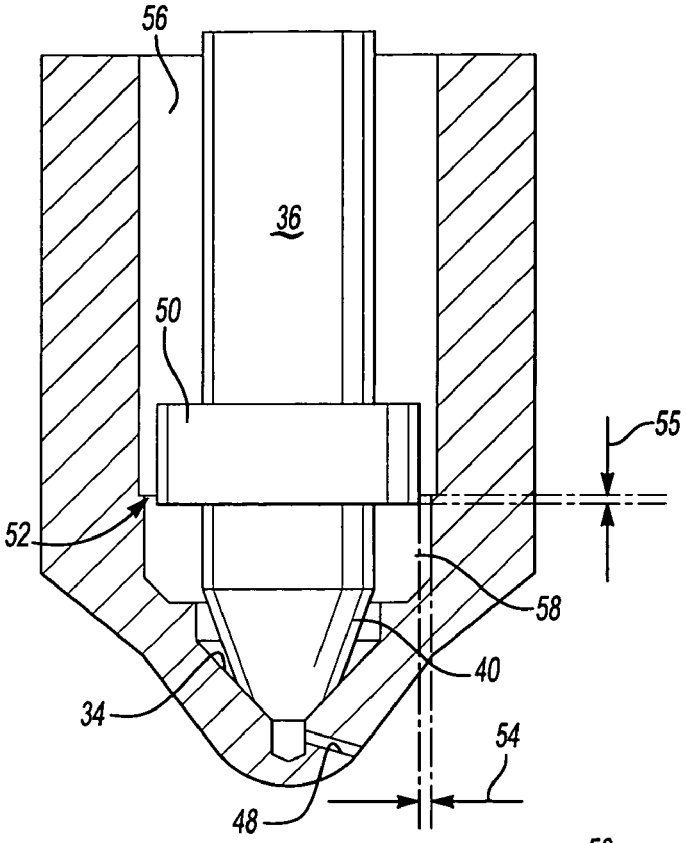
FIG. 2 is an enlarged cross-sectional view of a portion of the fuel injector in a closed position.
Figure 3:
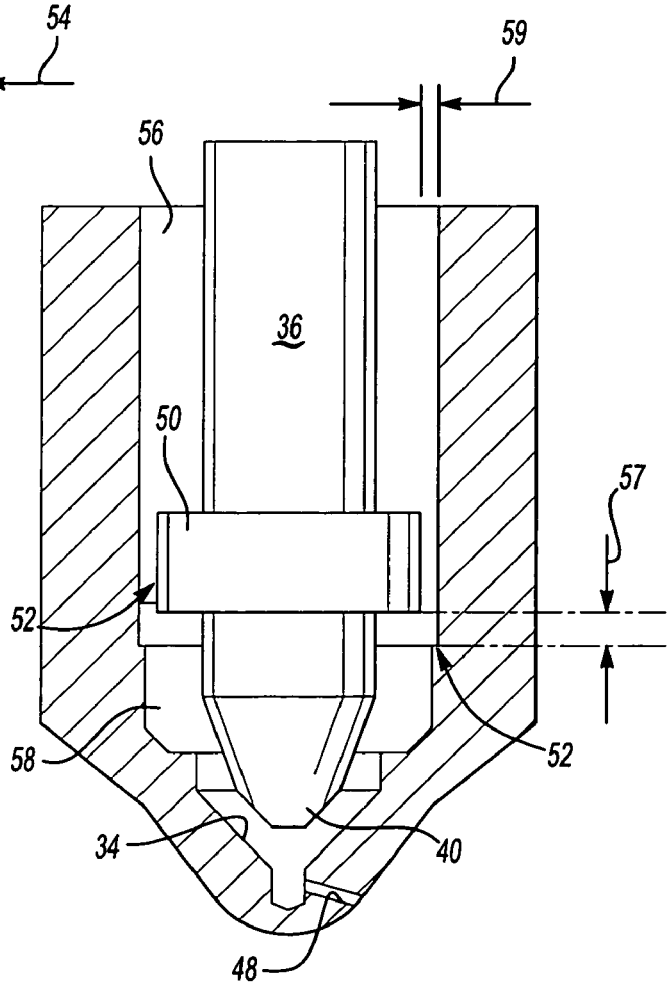
FIG. 3 is an enlarged cross-sectional view of the example fuel injector in an open position.

Referring to FIGS. 2 and 3, additional forces exerted on the needle valve 36 are controlled by the relationship between metering land 50 and metering edge 52 defined adjacent the outlet opening 48. Needle valve 36 is disposed within the metering bore 56 and includes the land 50. The land 50 includes an outer diameter that cooperates with a metering edge 52 to define an annular metering gap 54. The metering gap 54 defines a fuel flow path that produces a defined pressure drop between a metering bore 56 and an outlet bore 58. The pressure drop provides a lower pressure within the outlet bore 58 as compared to the metering bore 56. The pressure differential between the metering bore 56 and the outlet bore creates a downward bias on the needle valve 36 that slows opening of the needle valve 36. The metering land 50 overlaps the metering edge 52 by a distance 55 that combined with the gap 54 provides the desired fuel flow and pressure drop between the metering bore 56 and the outlet bore 58.

Referring to FIG. 3, the needle valve 36 is shown in an open position. In this position there is no overlap between the metering land 50 and the metering edge 52. The gap 59 between the metering land 50 and the metering bore 56 is such that no pressure drop is created and provides for the free flow of fuel. As should be appreciated, the forces generated by the pressure drop created by the relationship between the metering land 50 and the metering edge 52 are such that they contribute to but do not override forces of the valve 40. The metering land 50 and metering edge 52 contribute to biasing forces already exerted and provided by the pressure differential across the needle valve 56 to provide a fine tuning of response times for opening and closing of the fuel injector assembly 10.

During operation the piezo-electric actuator 42 actuates to create a pressure drop across the needle valve 36. The pressure on the needle valve 36 is such that the pressure above the needle valve 36 at the control piston portion 38 is less than that below the needle valve portion 36. This pressure differential acts against the biasing spring 46 to move the needle valve 36 upward off the seat 34. At the same time, fuel flow through the metering gap 54 generates a pressure drop that provides a force against the opening force to slow opening of the needle valve 36 as is desired. The specific gap 54 and overlap 55 between the metering land 50 and the metering edge 52 is determined to provide a desired pressure drop that provides the desired opening time of the needle valve 36.

Upon further opening of the needle valve 36, the gap 59 between the metering land 50 and the walls of the metering bore 56 is such that the fuel flowing through the annular passage defined there between does not create a pressure drop of any significance to cause a reduction in desired fuel flow.

Upon de-actuation of the actuator 42, pressure on the needle valve 36 between the control piston 38 and the needle valve portion 36 will equalize. The equalized pressure is then subject to the force exerted by the biasing spring 46 and moves the needle valve portion 36 downward onto the seat 34. The downward movement of the needle valve 36 is aided as the metering land 50 moves back into overlapping relationship with the metering edge 52. As the metering land 50 moves back into overlapping relationship with the metering edge 52, a pressure drop is created through the gap 54. The pressure drop creates a localized relative higher pressure on an upper side of the metering land 50 then is present on a lower side of the metering land 50. The imbalance of hydraulic pressure forces generated by the pressure differential between the upper side and lower side of the metering land 50 results in an added force for moving the needle valve 36 toward the seat 34. The closing time of the needle valve 36 can be tailored by adjusted the size of the gap 54 and overlap 55 between the metering land 50 and the metering edge 52.

Figure 4:
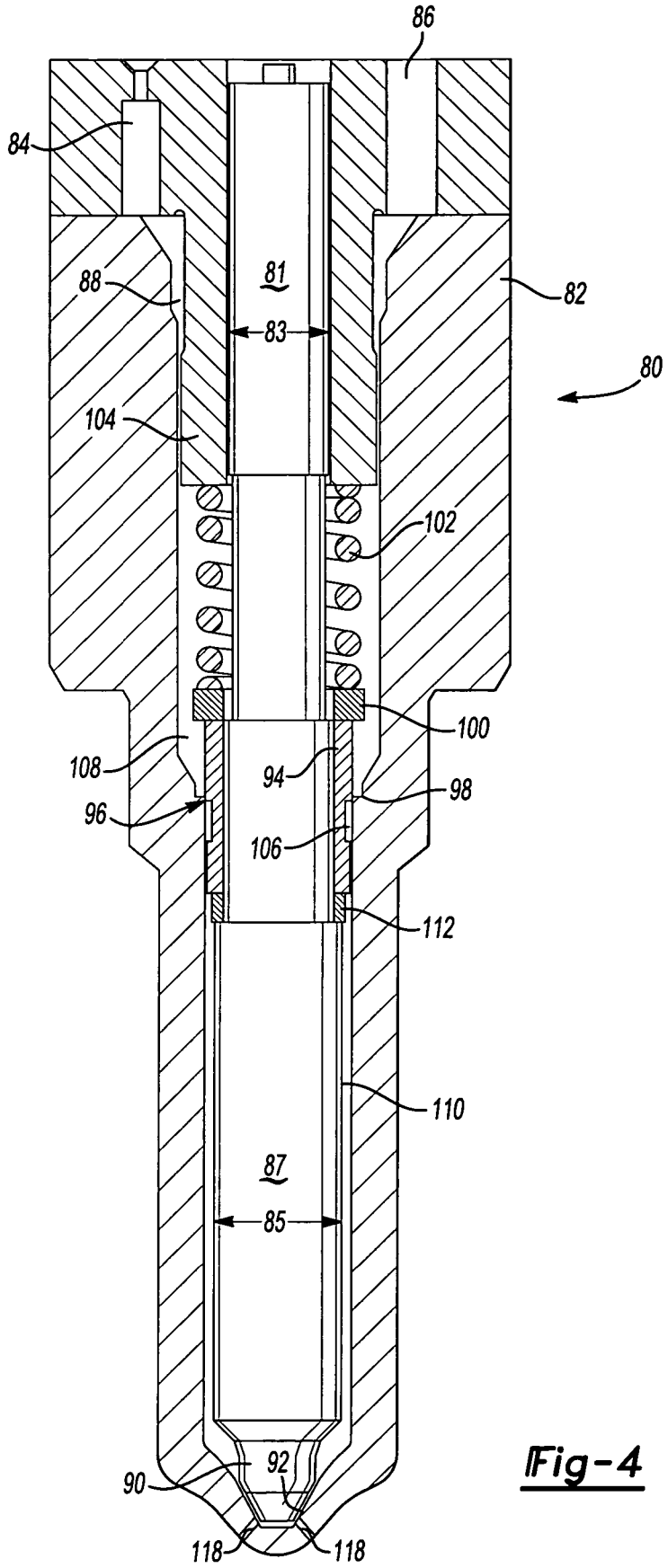
FIG. 4 is a cross-sectional view of another fuel injector according to this invention.

Referring to FIG. 4, another fuel injector assembly 80 according to this invention includes a housing 82 that defines a first bore 84, a second bore 86 and a third bore 88. The bores, 84, 86, 88 communicate fuel to a metering bore 108. The metering bore 108 contains a spring 102. A needle valve 90 moves between an open position and a closed position to selectively control fuel to flow through outlets 118. The needle valve 90 seals on a seat 92 to close fuel flow through the outlets 118. The needle valve 90 includes an upper portion 81 with a diameter 83 and a lower portion 87 with a diameter 85 that is larger than the diameter 83.

A metering sleeve 94 is disposed around the needle valve 90 to define the metering land 96 that cooperates with metering edge 98 disposed within the metering bore 108. The metering sleeve 94 is inserted onto the needle valve 90 and positioned relative to the metering edge 98 by a spacer 112 to align the metering land 96 with the metering edge 98. The spacer 112 provides for the adjustment of the overlap 116. Modifying the thickness of the spacer 112 provides for the adjustment of the overlap 116, and thereby the modification of flow characteristics past the metering edge 98. Another spacer 100 is disposed above the sleeve 94 to support the spring 102 between the spacer 100 and an insert 104. The spring 102 provides a biasing force towards the closed position where the needle valve 90 is sealed against the seat 92 to prevent fuel flow there through.

Figure 5:
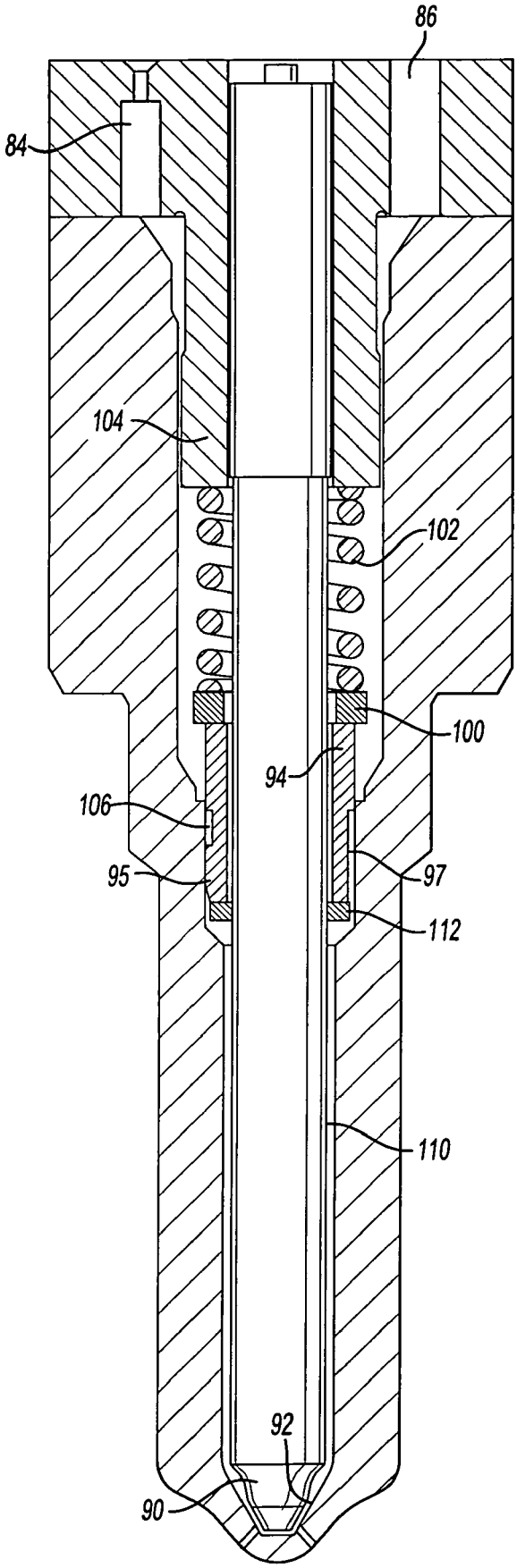
FIG. 5 is an enlarged cross-sectional view of a portion of an example fuel injector according to this invention.
Figure 6:
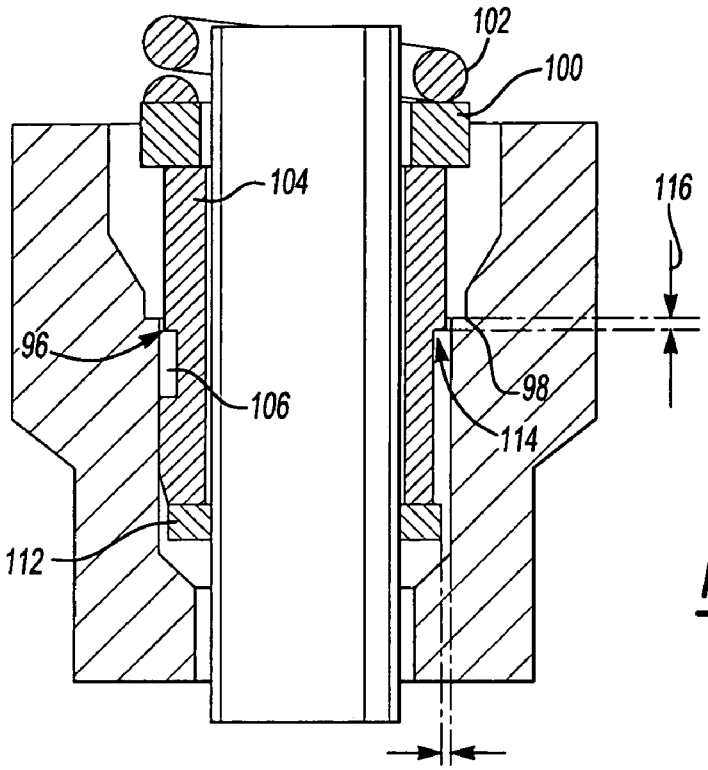
FIG. 6 is an enlarged cross-sectional view of a portion of the fuel injector in a closed position.
Figure 7:
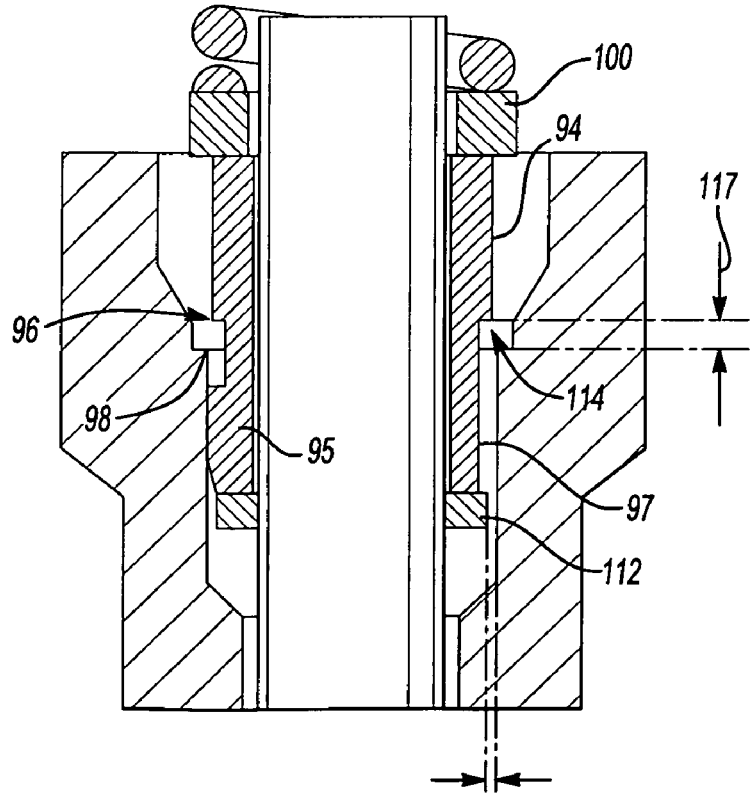
FIG. 7 is an enlarged cross-sectional view of a portion of the fuel injector in an opened position.

Referring to FIGS. 5, 6 and 7, the metering sleeve 94 defines the metering land 96 that cooperates with the metering edge 98 defined within the bore 108. The metering sleeve 94 includes guides 95 that extend radially into guiding contact with the inner surface of the bore 108. Between each of the guides 95 is a slot 97. The slot 97 defines an opening through which fuel flows after moving past the metering gap 114 defined between the metering land 96 and the metering edge 98. The guides 95 annular orientate the metering sleeve 94.

Referring to FIG. 6, the needle valve 90 is shown in a closed position where fuel flows through the metering gap 114 defined between the metering land 96 and the metering edge 98. The metering gap 114 is defined with a desired overlap 116 to provide a desired pressure drop as fuel passes there through. The desired pressure drop provides for the added control and tailoring of opening and closing response times of the needle valve 90.

Referring to FIG. 7, the needle valve 90 is shown in an open position where the needle valve 90 has moved upward a distance 117 such that there is no overlap between the metering land 96 and the metering edge 98. Fuel is free to flow through the slots 97 without any defined pressure drop. With no pressure drop, the pressure above and below the needle valve 90 is essentially equal providing full desired fuel flow, without a downward closing bias on the needle valve 90.

In operation, once the actuator 42 is actuated and the pressure imbalance on the needle valve 90 creates imbalance forces that lift the needle valve 90 off of the seat 92, the pressure differential across the metering gap 114 generates an additional slowing force that slows the opening response time of the needle valve 90. The pressure differential generated across the metering gap 114 only slows but does not overcome the overall opening bias, but allows for precise tailoring of opening and closing response times of the needle valve 90.

Once the actuator 42 has been deactivated the pressure on the needle valve 90 equalizes such that biasing force provided by the spring 102 begins moving the needle valve 92 to its closed position. Once the metering land 96 once again overlaps the metering edge 98 to form the metering gap 114, a pressure differential causes a quicker closing of the needle valve 90. The increase in closing force is provided by the pressure imbalance on the needle valve, with higher pressure across a top of the needle valve 90 and lower pressure on the bottom of the needle valve in the outlet bore 110. The resulting pressure bias aids in the closing response time of the needle valve 90.

Figures 8, 9, 10, 11:
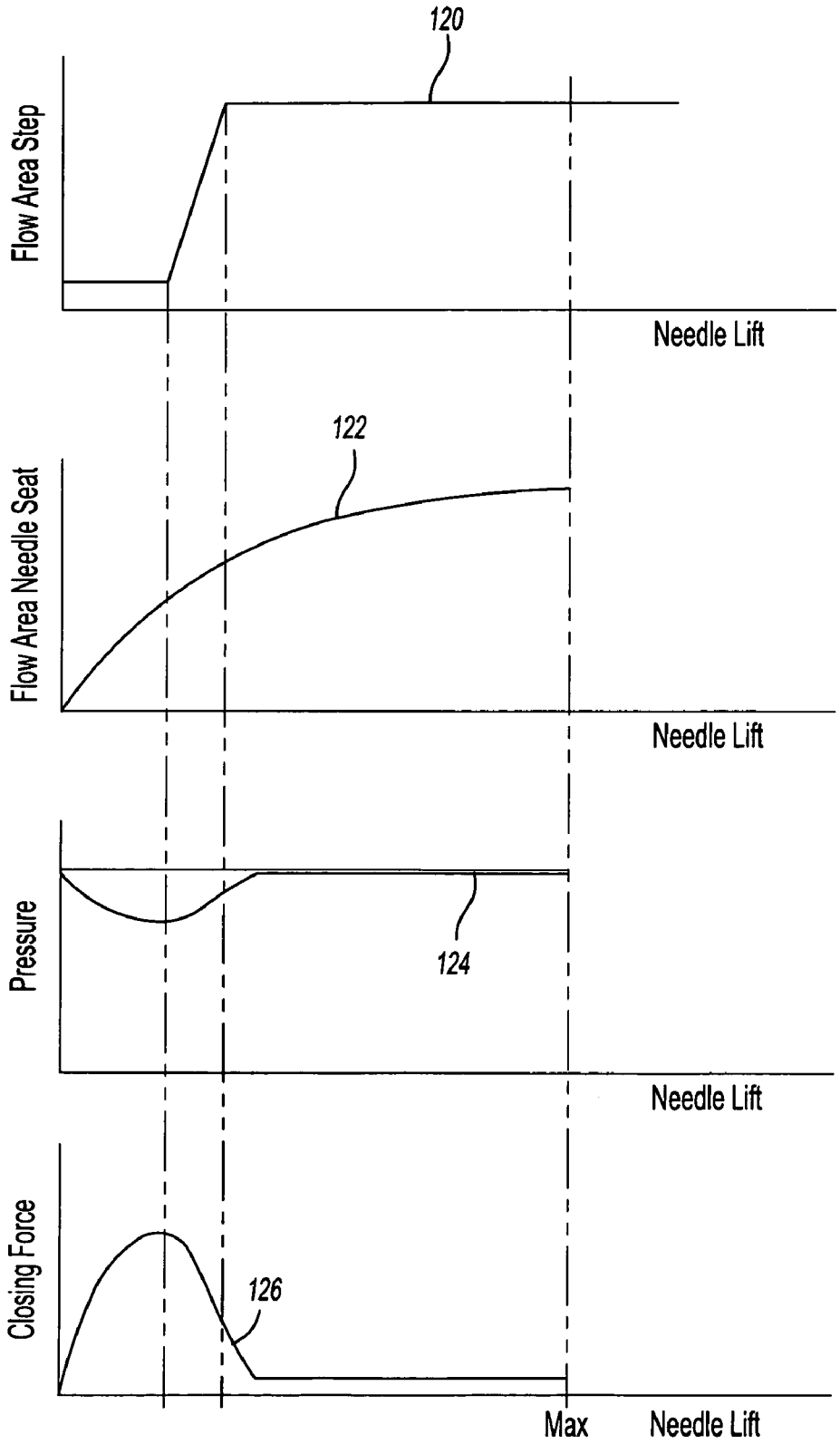
FIG. 8 is a graph illustrating an example relationship between fuel flow area and needle lift.
FIG. 9 is a graph illustrating an example relationship between flow area of the needle seat and needle lift.
FIG. 10 is a graph illustrating an example relationship between Pressure and needle lift.
FIG. 11 is a graph illustrating an example relationship between closing force and needle lift.

Referring to FIG. 8, a graph is shown that provides an example relationship 120 between the amount of needle lift and the flow area of the land. As the flow area increases, the lift of the needle increases until it reaches a steady state. As is appreciated, the specific flow area for a given application can be modified to provide the, desired needle lift at a desired time.

Referring to FIG. 9, another relationship 122 is shown between the flow area between the needle valve seat and needle lift. This is a smoother transition and provides an illustration of a relationship between the area of the needle seat and flow area for fuel flow through the needle opening dependent on the amount or the stroke of the needle valve.

Referring to FIG. 10, a relationship 124 between pressure and needle lift is illustrated. As is shown, initially pressure will drop until such time as a needle or the metering land opens sufficiently to allow pressure to remove any pressure drop and allow maximum fuel flow through the opening.

Referring to FIG. 11, a relationship 126 between closing force and needle lift is illustrated. The closing force ramps up dramatically as the metering land is still overlapping the metering edge. Once the metering land no longer overlaps the metering edge, the closing force drops off dramatically and becomes stable at a low force.

Accordingly, needle valve for a fuel injector according to this invention provides for the accurate and tailored calibration of opening and closing response times to improve engine performance and efficiency.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A fuel injector assembly comprising:

a housing defining a bore including an inlet and an outlet;

a needle valve movable between an open position that provides for fuel flow through the outlet, and a closed position preventing fuel flow through the outlet, the needle valve including an upper portion and a lower portion, where the upper portion includes a diameter smaller than the lower portion;

a valve for controlling movement of the needle valve by selectively controlling a pressure differential between the upper portion of the needle valve and the lower portion of the needle valve;

a sleeve disposed over the needle valve defining a metering land selectively overlapping a metering bore to define a flow passage that creates a desired pressure differential between an upper surface of the metering land and a lower surface that generates a hydraulic bias on the needle valve toward the closed position; and a spacer disposed below the metering sleeve for aligning the sleeve with a metering edge defined by the metering bore.

2. The assembly as recited in claim 1 wherein the spacer includes a thickness that is adjusted for providing a desired length of overlap of the metering land with the metering bore.

3. The assembly as recited in claim 1 wherein the sleeve includes guides that align the sleeve annularly within the metering bore.

4. A fuel injector assembly comprising:

a housing defining a bore including an inlet and an outlet;

a needle valve movable between an open position that provides for fuel flow through the outlet, and a closed position preventing fuel flow through the outlet, the needle valve including an upper portion and a lower portion;

a valve for controlling movement of the needle valve by selectively controlling a pressure differential between the upper portion of the needle valve and the lower portion of the needle valve;

a sleeve disposed over the needle valve defining a metering land selectively overlapping a metering bore to define a flow passage that creates a desire pressure differential between an upper surface of the metering land an a lower surface that generates a hydraulic bias on the needle valve toward the closed position;

a biasing member that biases the needle valve toward the closed position; and a spacer supported on the sleeve for supporting one end of the biasing member.

5. The assembly as recited in claim 1, wherein the valve comprises a piezo-electric valve.

* * * * *